United States Patent [19]

Ditcher

[11] 3,974,615

[45] Aug. 17, 1976

[54] APPARATUS FOR FORMING STEPS IN MANHOLES AND THE LIKE

[75] Inventor: John Ditcher, Langhorne, Pa.

[73] Assignee: A-Lok Corporation, Trenton, N.J.

[22] Filed: Apr. 22, 1974

[21] Appl. No.: 462,957

[52] U.S. Cl. ..... 52/698; 249/177; 182/92

[51] Int. Cl.[2] ..... E04G 15/04; E04G 5/04

[58] Field of Search ..... 52/184, 699, 704, 173, 52/698; 248/27; 249/177; 182/92

[56] References Cited

UNITED STATES PATENTS

| | | | |
|---|---|---|---|
| 1,482,565 | 2/1924 | Johnson et al. | 249/177 |
| 1,859,779 | 5/1932 | Lee | 52/363 |
| 1,987,035 | 1/1935 | Tideman | 248/27 X |
| 2,007,689 | 7/1935 | Merrill | 52/173 |
| 2,340,988 | 2/1944 | Ryder | 248/27 |
| 2,424,757 | 7/1947 | Klumpp | 248/27 X |
| 2,857,754 | 10/1958 | Reinert | 52/704 |
| 2,930,505 | 3/1960 | Meyer | 248/27 |
| 3,200,903 | 8/1965 | Marino | 182/92 |
| 3,265,349 | 8/1966 | Hamrick | 249/177 |
| 3,299,984 | 1/1967 | Suedahl | 52/184 |
| 3,346,230 | 10/1967 | Tolf | 249/177 |
| 3,374,859 | 3/1968 | Dobert | 52/184 |
| 3,418,781 | 12/1968 | Penote | 52/704 |

*Primary Examiner*—Ernest R. Purser
*Assistant Examiner*—James L. Ridgill, Jr.
*Attorney, Agent, or Firm*—Ostrolenk, Faber, Gerb & Soffen

[57] ABSTRACT

Method and apparatus for forming steps in manhole structures. Manhole assembly is comprised of pre-cast concrete sections. Each such section is formed in an appropriate mold typically comprised of inner and outer mold shells. The inner shell is provided with pairs of openings arranged in a predetermined fashion. Plastic core members are snap fittingly inserted into the openings and are provided with resilient pairs of flanges which cooperate with the marginal edges of each opening to retain the core in proper position and alignment. The concrete is placed in the mold. One set and cured, the section is removed from the mold. The plastic core members are snapped free from their locked position with the mold inner shell and remain as an integral part of the cured section. U-shaped stepped sections are force fittingly inserted into the cores which serve to retain each step member in position.

4 Claims, 10 Drawing Figures

APPARATUS FOR FORMING STEPS IN MANHOLES AND THE LIKE

The present invention relates to a method and apparatus for forming steps in concrete and more particularly to a novel method and apparatus for force fittingly mounting steps in manhole sections and the like through the employment of novel plastic core members. Related application Ser. No. 452,677 now U.S. Pat. No. 3,891,224 teaches the sections made by the present invention.

BACKGROUND OF THE INVENTION

Manhole assemblies are typically formed of precast concrete sections which are produced according to specifications at the manufacturing site and are assembled at the job site. Federal and/or state regulations typically require that the manhole assembly be provided with manhole steps which are conventionally either cast or mortared into the wall of the manhole sections to provide safe ingress and/or egrees into the manhole assembly. The sections are typically cast in molds in which the step members are either integrally cast as part of the casting operation or are subsequently mortared into position. In one preferred arrangement, the inner shell of a mold member receives sliding steel pins which are reciprocally mounted upon the inner shell so as to project into the hollow annular region defined by the mold shells for forming a particular manhole section. Once the concrete is cast and cured, the pins are removed, the precast section is removed from the mold and the steps are mortared into place within the openings formed by the steel pins, the mortar being required in order to provide for adequate retention of the steps within the precast section. Also, removal of the steel pins may also damage the openings which receive the individual step members thus complicating the joining of step members to the precast sections. The above disadvantages thereby tend to complicate the formation of manhole sections having steps.

BRIEF DESCRIPTION OF THE INVENTION

The present invention is characterized by providing a novel method and apparatus for greatly simplifying the production of manhole sections and the like through the use of novel plastic core members which are provided with pairs of resilient flanges enabling the core members to be snap fittingly positioned into the molds and thereby serve as a means for retaining the core members in their proper position within the mold. The section is then cast and cured. After curing, the section is removed from the mold. One pair of flanges in each core member are caused to be snappingly released from one shell of the mold without the core members being damaged in any way due to the resiliency of the flanges. The cores then serve as means for receiving the steps which are force fittingly inserted into the cores, the nature of the core material being adapted to compensate for the steps received therein to provide a good force fit, the completed assembly being found to be fully compliant with all state, local and/or federal requirements regarding safety and strength while at the same time greatly simplifying the formation of manhole sections.

BRIEF DESCRIPTION OF THE FIGURES AND OBJECTS

It is therefore one object of the present invention to provide a novel method and apparatus for forming precast manhole sections and the like and utilizing a method step of providing plastic core members which are snap-fittingly inserted within the mold of a manhole section for self retention of the core members during the casting operations, the resilient nature of the core members being such as to be snappingly released from the mold after casting.

Another object of the present invention is to provide a novel plastic core for use in manhole sections and the like, said core members having first and second pairs of resilient flanges to permit their snap fitting insertion into the mold and to similarly enable the core members to be snappingly released from the mold after the sections have been cast, said cores serving as a means for force fittingly mounting the individual step members.

The above as well as other objects of the present invention will become apparent from the accompanying description and drawings in which:

FIG. 1 shows an exploded perspective view employed for forming precast concrete manhole sections and the like.

FIG. 1*a* shows a sectional view of FIG. 1 incorporating the plastic insert and after casting of the section but before removal of the casting from the mold.

Figure 3:
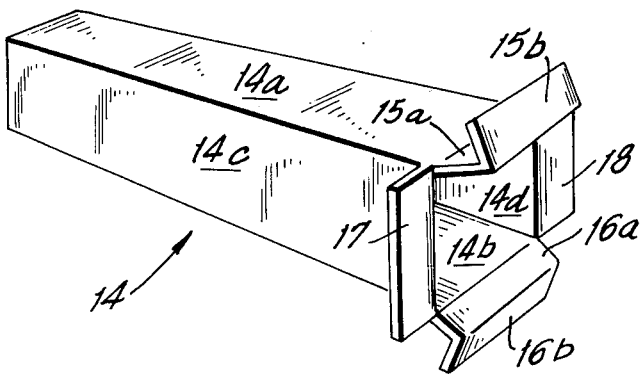
FIG. 3 shows a perspective view of a plastic core designed in accordance with the principles of the present invention.
Figure 4B:
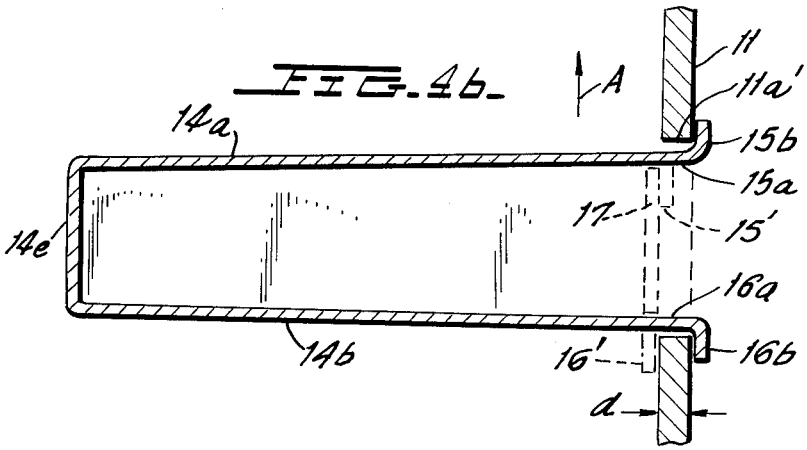
Figure 4A:
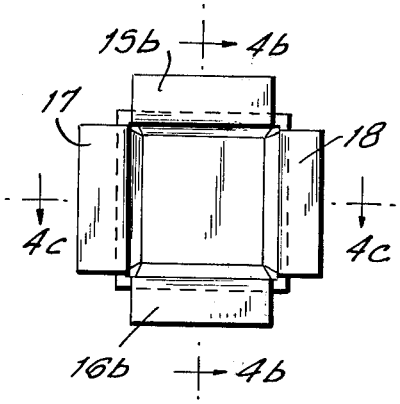

FIG. 4*a* shows a front view of the core member of FIG. 3.

FIG. 4*b* shows a sectional view of the core of FIG. 4*a* looking in the direction of arrows 4*b*—4*b* and inserted within a mold member.

Figure 4C:
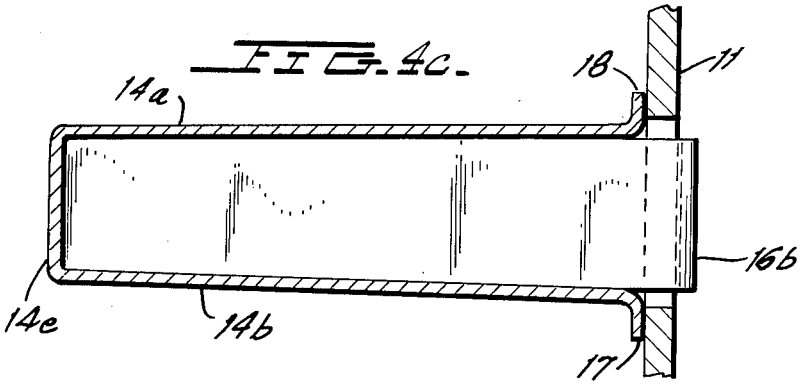

FIG. 4*c* shows a sectional view of the core member of FIG. 4*a* looking in the direction of arrows 4*c*—4*c*, with the core being mounted within a mold member.

Figure 4F:
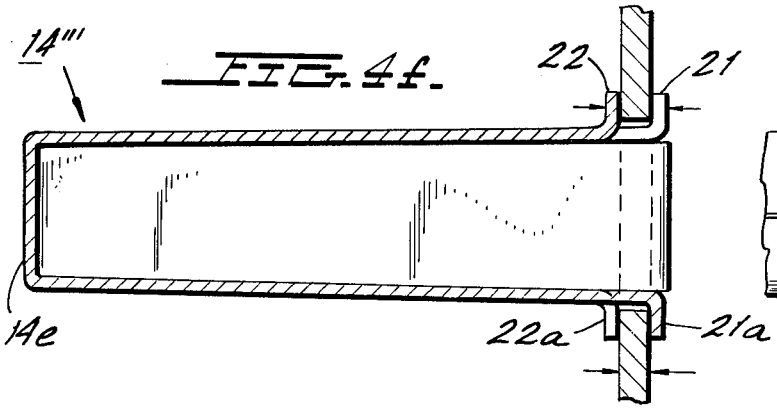
Figure 4D:
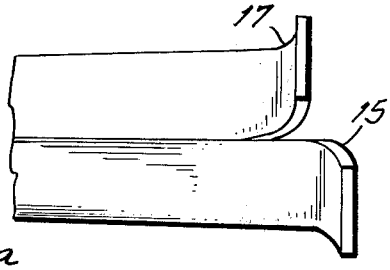

FIG. 4*d* shows a side view of a slightly modified core from that of FIG. 3.

Figure 4E:
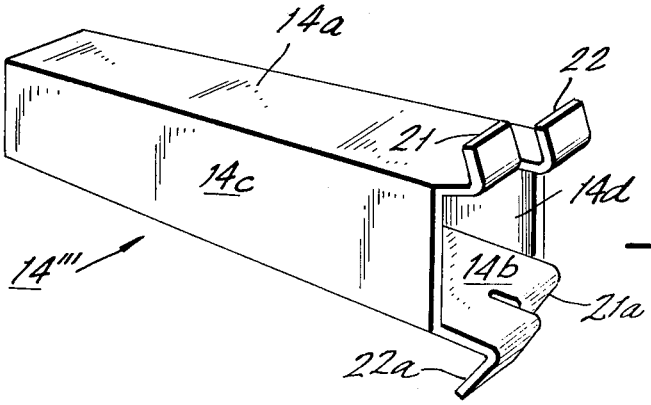

FIG. 4*e* shows a perspective view of still another preferred embodiment of the plastic core of the present invention.

FIG. 4*f* shows a partially sectionalized view of the alternative embodiment of FIG. 4*e* with this embodiment shown as being inserted into the mold.

DETAILED DESCRIPTION OF THE INVENTION

Figure 1:
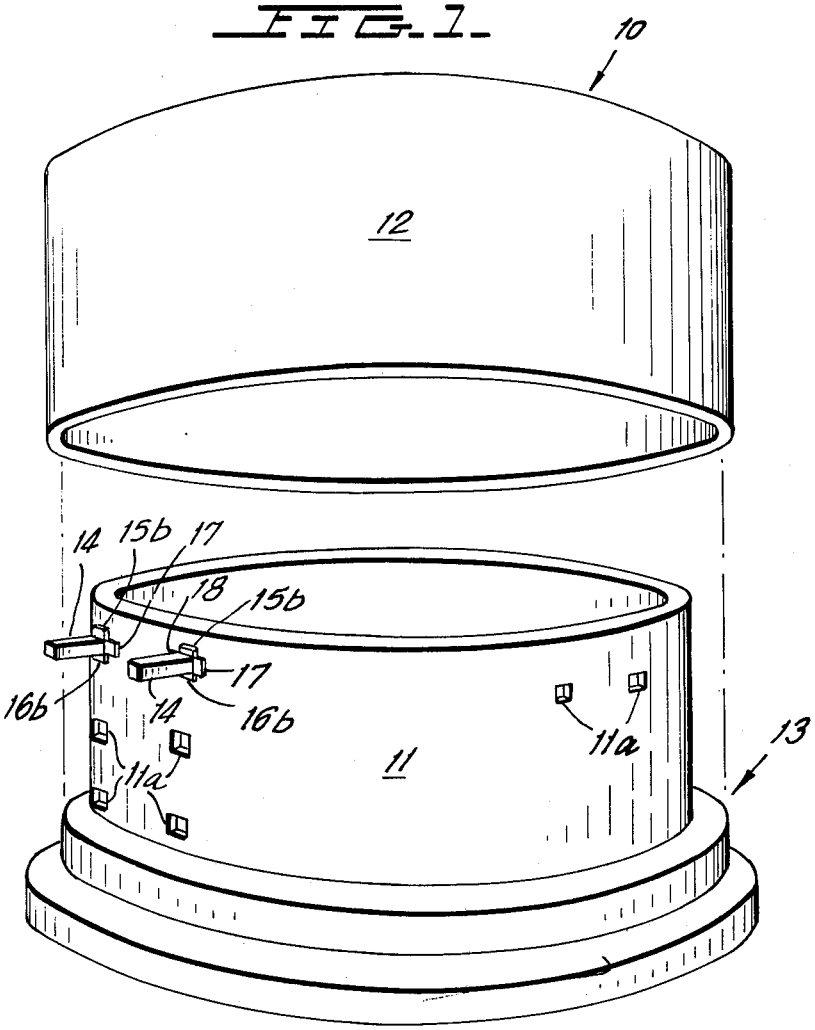

In the production of precast concrete manholes, it is conventional to form the manholes in sections which are precast at the factory according to specifications of the particular job. The precast sections are then transported to the job site and assembled thereat. A representative manhole structure is shown, for example, in detail in copending U.S. application Ser. No. 452,677 filed Mar. 20, 1974 now U.S. Pat. No. 3,891,224 and assigned to the assignee of the present application. FIG. 1 of the aforesaid pending application shows typical manhole sections such as, for example, a base section, one or more riser sections and a conical section topped off by a collar section with the specifications and characteristics of each of these sections being determined by the particular job.

Although not shown in the aforesaid copending application, it is quite difficult to provide manhole steps within the manhole structure which steps are usually required to comply with federal, state and/or local ordinances provided therefore. Each of the steps collectively form a ladder structure to facilitate ingress and egress within the manhole.

FIG. 1 shows, in exploded form, a typical mold assembly 10 comprised of an inner metallic cylindrical shell 11, concentrically arranged outer cylindrical metallic shell 12 and an annular metallic base member 13.

The shell members now are appropriately positioned upon the base member 13, define a hollow annular region for receiving concrete which is poured into the mold to cast the sections. An upper mold member (not shown for purposes of simplicity) is inserted into the annular spaced region and serves to form a joint assembly as does the lower mold member or base member 13. For example, in forming a riser section, the bottom end thereof (relative to FIG. 1) would typically be provided with a male end while the top end thereof would be provided with a female end, said male and female ends serving to be joined with corresponding female and male ends respectively thus cooperatively forming a joint for properly interfitting precast sections of the mold.

It is typical to provide an assembled manhole structure with steps that are cast or mortared into the walls of the riser and/or conical sections with each step being capable of supporting a live load of the order of 300 pounds the steps being equally spaced in a vertical direction a distance of no greater than 16 inches apart with each step being imbedded in a section a minimum distance of the order of 3 inches and with a width of individual steps being at least 10 inches measured in a horizontal direction and with each step projecting inwardly from its associated precast section a minimum clear distance of the order of 4 inches.

To provide for steps within each precast section, the interior mold member 11 is provided with pairs of openings 11a with the spacing between each opening of the pair being in accordance with the above mentioned dimensional requirements and with the distance between pairs measured in a vertical direction also conforming to the above dimensional requirements.

In order to form openings within the concrete precast section, plastic core members are snap fitted to the openings 11a provided in the interior mold shell. FIGS. 1*a*, 3 and 4*a* through 4*d* show a number of views of one preferred embodiment of a plastic core member 14 which is comprised of an elongated hollow section of rectangular cross-section having upper and lower side walls 14*a* and 14*b* respectively and having left and right hand sidewalls 14*c* and 14*d* respectively, which sidewalls define the elongated rectangular shaped section. The inner end of the plastic core is sealed at 14*e* as shown best in FIGS. 4B and 4C.

Upper and lower sidewalls 14*a* and 14*b* are each provided with resilient flanges as are left and right hand side walls 14*c* and 14*d*. The flange of upper sidewall 14*a* has a portion 15*a* extending outwardly at a slight angle from upper sidewall 14*a* and has a portion 15*b* extending substantially at right angles to portion 15*a*. Lower sidewall 14*b* has a similar shaped flange comprised of flange sections 16*a* and 16*d* which is substantially mirror images of the flange portions 15*a* and 15*b* already described herein above.

Left and right hand sidewalls 14*c* and 14*d* are each provided with flanges 17 and 18 which extend substantially at right angles to their associated left and right hand sidewalls 14*c* and 14*d* as can best be seen in FIG. 3. The plastic core 14 is preferably formed of a material of sufficient resiliency such as, for example, polyvinyl chloride. However, it should be understood that any other plastic having similar properties may be utilized. It can clearly be seen from FIGS. 3, 4*b* and 4*c* that the flange portions 15*b* and 16*b* are separated from flanges 17 and 18 by a distance *d* as can best be seen in FIGS. 3 and 4*b*.

The manner in which the plastic cores are utilized is as follows (specific reference being had to FIGS. 1,1*a*, 4*b* and 4*c*):

The plastic cores are mounted to inner mold shell 11 shown in FIG. 1 such that the cores are positioned within the interior of mold shell 11. The inward ends 14*e* of the mold cores are inserted through openings 11*a* so as to extend outwardly through the openings 11*a* as shown best in FIG. 1. Core members are pushed through openings 11*a* until the flanges 17 and 18 which are aligned in vertical fashion, are passed through the openings 11*a* until they are freed of the openings, at which time they snap back into their normal position so that one surface of the flanges 17 and 18 bear against the exterior surface of inner mold shell 11. The flange portions 15*a* and 16*a* are caused to be bent inwardly slightly as shown best in FIG. 4*d* so as to be substantially coplanar with their integral top and bottom sidewalls 14*a* and 14*b* as shown best in FIG. 4b. In this position, it can be seen that each plastic core member is retained by the inner mold shell 11 due to the fact that the marginal portions of each opening 11*a* are embraced along the interior surface of shell 11 by flanges 17 and 18 and are embraced along the exterior surface of shell 11 by flange portions 15*b* and 16*b*. With the arrangement shown in FIG. 1 it should be understood that the flanges 17 and 18 are vertically aligned while the flange portions 15*b* and 16*b* are horizontally aligned.

Figure 1A:
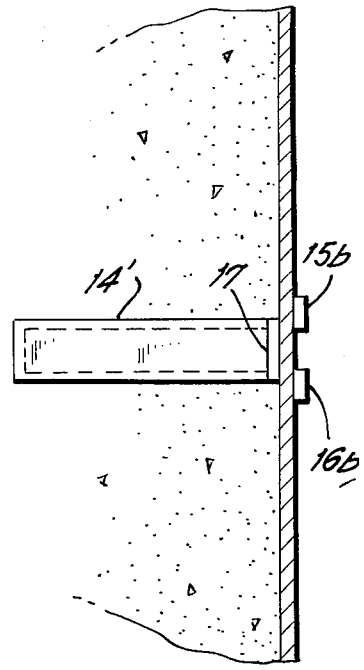

Once the plastic core members have been inserted in the manner set forth hereinabove, the concrete may be poured into the mold sections. The snap fitting arrangement of the plastic core members is sufficient to prevent any movement thereof during the casting operation. The concrete will be caused to form about each of the plastic core members. Although not set forth herein in detail (for purposes of simplicity) it should be understood that the lower mold section 13 and the upper mold section which has been omitted for purposes of simplicity would be utilized to form appropriate male and female ends for the mold section being cast. FIG. 1*a* shows the wet cast concrete wall formed within the mold assembly of FIG. 1 and set about a typical plastic core member 14'.

After casting and curing of the mold section, the section is removed from the mold members through relative vertical movement of the sections with respect to the inner and outer mold shells 11 and 12. Considering FIG. 4*b* for example, let it be assumed that the cured section is moved upwardly in the direction shown by arrow A relative to shell 11. This relative movement will cause the upper marginal edge 11*a'* of opening 11 to bend flange portions 15*a* and/or 15*b* downwardly so as to be in a position shown by dotted lines 15' as the section is lifted out of the mold. Similarly flanged portions 16*a* and 16*b* will be bent downwardly as they come into contact with the upper marginal edge 11*a'* of opening 11*a* so as to substantially occupy the position shown by dotted lines 16'. As soon as these flanges are free of the upper edge of inner mold shell 11, they will snap back to their normal position as shown for example in FIG. 3. It should be noted that flanges 17 and 18 which are positioned along the exterior surface of mold member 11, undergo no bending. It should be noted however that it is important to orient the plastic core members as in the manner described hereinabove so as to prevent the flanges 15*a*–15*b* and 16*a*–16*b* from being torn away from the core member to which they are integrally joined as a result of removing the precast section from the mold assembly.

Figure 2:
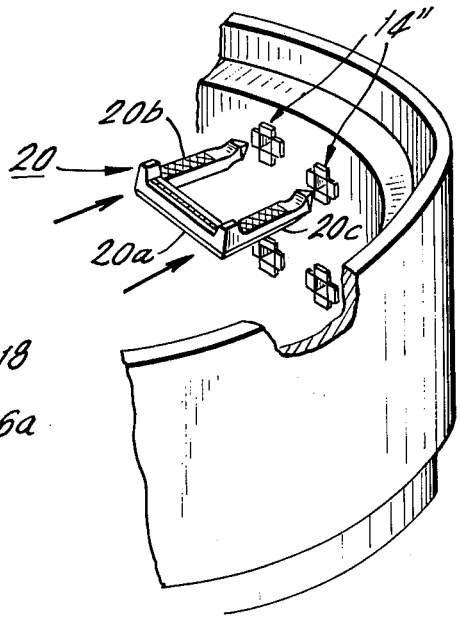
FIG. 2 shows a perspective partially exploded view of a section cast from a mold of the nature shown in FIG. 1.

FIG. 2 shows a perspective view of a typical precast section after having been removed from the mold. A step 20 having a substantially U-shaped configuration and comprised of a yoke portion 20*a* and integrally formed arms 20*b* and 20*c* is, in one preferred embodiment, comprised of a substantially U-shaped steel core covered with a rugged rubber outer shell. However, the individual step members 20 may be formed of iron steel, aluminum (having a substantially rectangular cross-sectional configuration and having a hollow interior) or any other suitable material. The free ends of the arms 20*b* and 20*c* are positioned within the openings defined by the cores 14'' and are force fittingly inserted into this pair of cores for example by means of a heavy rubber mallet. In the case where each individual step is comprised of a metallic core covered with a shell of resilient rubber, the dimensional relationship between the interior of the plastic cores and the exterior of the arms 20*b* and 20*c* is such as to provide an extremely good force fit therebetween. In the case where metallic steps having no resilient exterior shell are employed, the plastic cores are adapted to "give" somewhat to also provide an excellent type force fitting relationship between the arms 20*b* and 20*c* and the plastic cores. This force fitting assembly provides a good type fit between the precast sections and the steps so as to completely eliminate the need for mortaring the steps into position thereby greatly simplifying the fabrication operation of manhole sections.

Whereas the invention described herein teaches a novel method and apparatus for forming steps in precast manhole sections, it should be understood that the method and apparatus described herein may be employed in any type of precast sections requiring either steps or other forms of projections within the cast member.

FIGS. 4*e* and 4*f* show another alternative embodiment for the present invention in which the plastic core member 14''' comprises an end wall 14*e*, top and bottom sidewalls 14*a* and 14*b* and left and right hand sidewalls 14*c* and 14*d* which are substantially identical to those shown in the embodiment of FIGS. 3 and 4*a*–4*c*. The difference between the embodiments 14 of FIG. 3 and 14''' of FIGS. 4E and 4F resides in the fact that flanges 17 and 18 of left and right hand sidewalls 14*c* and 14*d* are eliminated and wherein the upper and lower sidewalls 14*a* and 14*b* are each provided with first and second flanges which form flange pairs to be more fully described.

Considering upper sidewall 14*a*, right hand end thereof is provided with integrally formed flanges 21 and 22 which curve upwardly and outwardly away from sidewall 14*a*. Similarly, lower sidewall 14*b* is provided with first and second flanges 21*a* and 22*a* which curve outwardly and downwardly from lower sidewall 14*b*. Flanges 21 and 21*a* can be seen to extend beyond their respective upper and lower sidewalls by a distance *d* as compared with flanges 22 and 22*a*. FIG. 4 shows this arrangement best wherein the plastic core embodiment of FIGS. 4*e* and 4*f* is inserted into the mold assembly in the same manner as that described with respect to the plastic core member 14 of FIG. 3. The flanges 22 and 22*a*, which are shown as being diagonally opposite one another are caused to be bent inwardly as they pass through an opening 11*a* until they are free of the opening at which time they are snapped back to their normal postion shown best in FIG. 4*f*. Thus flanges 21 and 22 are caused to embrace a marginal portion of opening 11*a* therebetween and along the upper edge of an opening 11*a*. In a similar fashion flanges 21*a* and 22*a* are caused to embrace therebetween the lower marginal portion of an opening 11*a* so as to retain the plastic core member 14''' in position during the casting operation. By arranging the flanges 21–21*a* diagonally opposite from one another and by similarly arranging the flanges 22–22*a* diagonally opposite from one another, the plastic core member 14''' is caused to maintain proper alignment within the mold assembly. Removal of the cast member after curing may be done in substantially the same fashion as the embodiment described hereinabove wherein the flanges 21 and 21*a* will be caused to be bent in a manner similar to that described in connection with the flanges 15*a*–15*b* and 16*a*–16*b* whereby these flanges will snap back to their normal positions as shown in FIG. 4*e* once the flanges are clear of the inner shell 11. Step members such as the step member 20 shown in FIG. 2 may be force fittingly inserted into the plastic core members in the same manner as was described hereinabove in connection with the core member 14.

It should further be noted that the flanges of the embodiment of FIG. 3 may have a continuous curvature similar to that shown in the embodiment of FIGS. 4*e* and 4*f* with typical flanges 17 and 15' of curve configuration being shown in the embodiment of FIG. 4*d*.

It can be seen from the foregoing description that the present invention provides a novel method and apparatus for simply and readily and inexpensively providing steps within precast sections such as for example manhole sections through the use of novel plastic core members which are simply and readily snap fitted onto a mold assembly and which are easily removed from the mold assembly after the precast sections are cured, the plastic core members being capable of being produced inexpensively such as for example through an injection molding operation.

Although there have been described preferred embodiments of this novel invention, many variations and modifications will now be apparent to those skilled in the art. Therefore this invention is to be limited, not by the specific disclosure herein, but only by the appended claims.

The embodiments of the invention in which an exclusive property or privilege is claimed are defined as follows:

1. In a mold assembly, core members for use in said assembly to form cast bodies, said mold assembly having inner and outer mold members defining a hollow mold space therebetween, wherein one wall of one of said mold members is provided with rectangular shaped openings which define locations for anchoring rod-like members to said cast body, each core member comprising:

a one-piece elongated hollow molded plastic body of rectangular cross-section having a first open end and a second sealed end, the length of said body being much greater than either width;

first and second pairs of resilient flanges integrally joined to said body adjacent said open end and extending in a direction perpendicular to the longitudinal axis of said body;

said first pair of flanges being substantially coplanar, said second pair of flanges being substantially coplanar and being spaced a predetermined distance inward from said first pair of flanges, said first and second pairs of flanges cooperating to embracing opposite surfaces of the marginal portion of said one mold member and surrounding said opening to maintaining the core member in proper alignment;

at least one of said pair of flanges being resilient along their lengths in said transverse direction to facilitate continuous bending thereof;

said core members each being inserted into each of said openings from a first side of said wall, whereby, upon insertion, said flexible flanges are adapted to flex to clear the opening and after insertion, snap-free of the associated opening to position said first and second pairs of flanges along opposite surfaces of the opening in the mold wall to retain the core member in position prior to insertion of the casting material and, upon withdrawal of the cast body from the mold, to enable one of the pairs of flanges to snap-free of the wall opening and return to the unflexed position while said core member is retained in the hardened casting material being removed from the mold.

2. The core member of claim 1 wherein the first pair of flanges are joined to opposing sidewalls of said body and wherein the second pair of flanges are joined to the same opposing sidewalls as said first pair of flanges.

3. The apparatus of claim 1 wherein the casting material is concrete.

4. The core member of claim 1 wherein said resilient pair of flanges are integrally joined to opposing sidewalls of said body and the remaining pair of flanges are joined to the remaining opposing sidewalls of said body.

* * * * *

UNITED STATES PATENT AND TRADEMARK OFFICE

CERTIFICATE OF CORRECTION

PATENT NO. : 3,974,615

DATED : August 17, 1976

INVENTOR(S) : JOHN DITCHER

It is certified that error appears in the above-identified patent and that said Letters Patent are hereby corrected as shown below:

Claim 1, line 15, delete "cooperating to";

line 17, "to" should read --and--.

Signed and Sealed this

*Fifteenth* Day of *August 1978*

[SEAL]

*Attest:*

RUTH C. MASON
*Attesting Officer*

DONALD W. BANNER
*Commissioner of Patents and Trademark*